United States Patent [19]

von Starck et al.

[11] 4,244,419

[45] Jan. 13, 1981

[54] ELECTROMAGNETIC STIRRING APPARATUS

[75] Inventors: Axel von Starck, Remscheid; Hans-Erwin Gerbig, Hückeswagen-Wiehagen; Hans Schrewe, Duisburg; Jurgen Sardemann, Essen, all of Fed. Rep. of Germany

[73] Assignee: Mannesmann Aktiengesellschaft, Dusseldorf, Fed. Rep. of Germany

[21] Appl. No.: 21,428

[22] Filed: Mar. 16, 1979

[30] Foreign Application Priority Data

Apr. 26, 1978 [DE] Fed. Rep. of Germany ..... 2818183

[51] Int. Cl.[3] ..... B22D 27/02

[52] U.S. Cl. ..... 164/147; 164/49; 219/10.69

[58] Field of Search ..... 164/49, 147, 82, 250, 164/251; 219/10.67, 10.69

[56] References Cited

U.S. PATENT DOCUMENTS

| | | | |
|---|---|---|---|
| 1,564,731 | 12/1925 | Weatherby | 209/223 R |
| 2,839,651 | 6/1958 | Erickson | 219/10.69 |
| 4,030,534 | 6/1977 | Ito et al. | 164/147 |

*Primary Examiner*—Robert D. Baldwin
*Assistant Examiner*—K. Y. Lin
*Attorney, Agent, or Firm*—Cushman, Darby & Cushman

[57] ABSTRACT

An electromagnetic stirring apparatus for stirring the liquid center core of a continuous casting. The casting is supported by and transported over guide rolls while a changing electromagnetic field is induced within the liquid casting core by induction coils positioned beneath the casting. Fingers of a stack of ferromagnetic plates form the cores of the induction coils and are positioned between the guide rolls and are close enough to the casting to induce a strong field therein.

5 Claims, 3 Drawing Figures

Fig.1
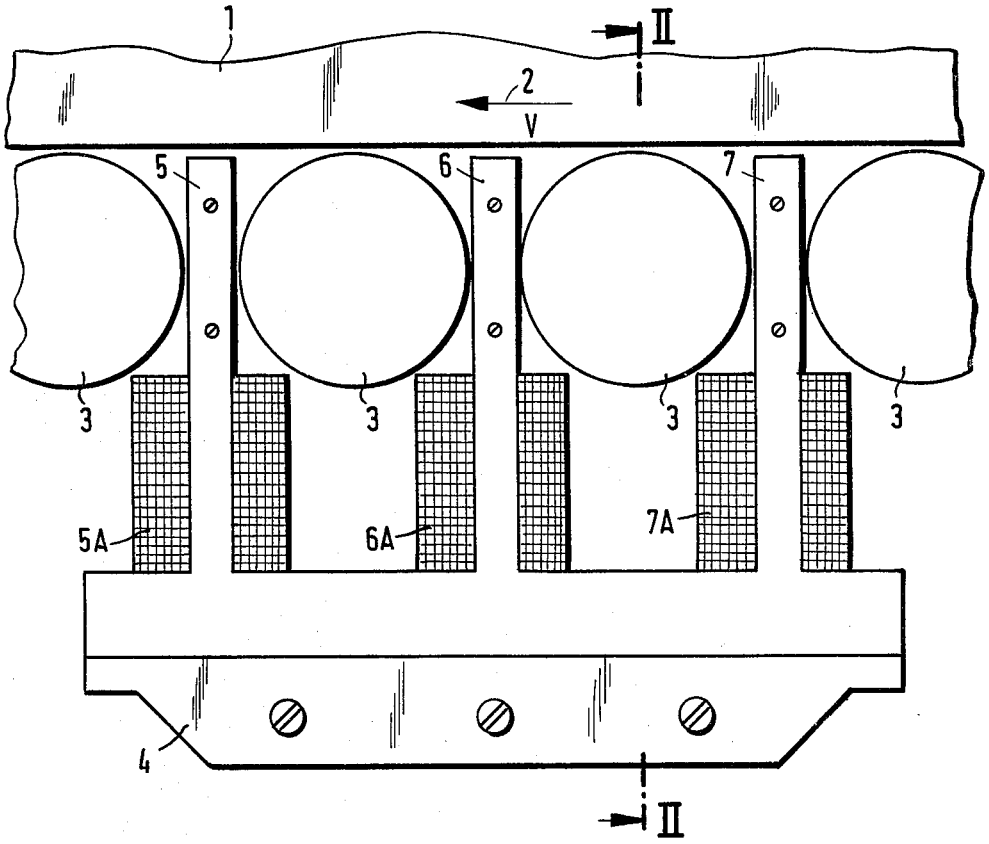
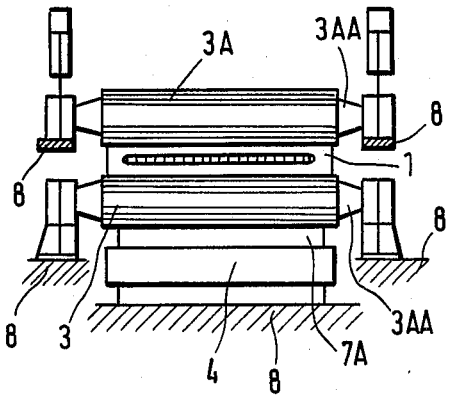
Fig.2
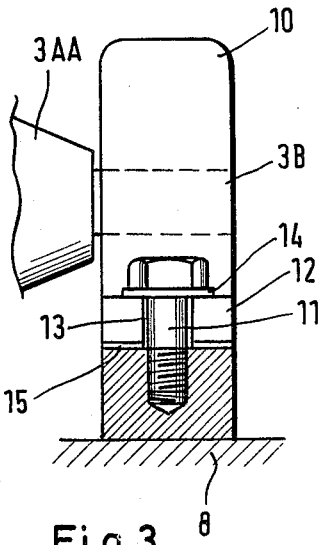
Fig.3

ELECTROMAGNETIC STIRRING APPARATUS

BACKGROUND OF THE INVENTION

This invention relates generally to continuous casting of steel or other metals or alloys and specifically to apparatus for stirring the solidifying core of such a continuous casting.

Electromagnetic stirring apparatus for continuous casting operations are known in the art. One such prior art device is disclosed in German Pat. No. P 27 56 623.0. Generally such apparatus are positioned near to the continuous casting under production but far enough away from it that supporting rolls and transport are not be touched or impeded. Due to the mechanical configurations of the prior art devices when utilized with guide rolls having good conductivity, excessive leakage fields are induced, leading to poor performance due to losses.

SUMMARY OF THE INVENTION

It is therefore the primary object of the present invention to provide an electromagnetic stirring apparatus for a continuous casting operation.

A further object of the present invention is to provide an electromagnetic stirring apparatus having reduced leakage field losses.

These and other objects of the present invention are achieved by providing an electromagnetic stirring apparatus mechanically configured to minimize leakage field paths. Guide rolls on which the continuous casting is transported are electrically insulated both from one another and from the source of electromagnetic field. Teeth having induction coils wound thereon extend upwards from a stack of ferromagnetic sheets and are disposed between electrically isolated guide rolls. Utilizing the configuration according to the present invention the electromagnetic flux generated by an induction coil is forced through the continuous casting thereby inducing highly efficient stirring within the casting. Leakage flux through the guide rolls is minimized. This configuration advantageously eliminates electric short circuit paths which have, in prior art devices, run across adjacent guide rolls of the installation, directly to nearby teeth without penetrating the casting through which it was intended to flow, decreasing the desired stirring effect. In addition, the stirring apparatus according to the present invention permits the use of customary electrically conductive materials for construction of the guide rolls.

A changing electromagnetic field is induced within the continuous casting by induction coils disposed around free standing teeth pointing into the mass of the continuous casting. These teeth run to a stack of ferromagnetic sheets mounted on the continuous casting apparatus in the roller frame of the continuous guide rollers. Two adjacent teeth of the stack of sheets include a guide roll of the continuous casting therebetween and every tooth has a longitudinal extension running in the direction of the rotational axis of the guide rollers. The guide rollers, between teeth, are fabricated from nonmagnetic but electrically conductive material.

BRIEF DESCRIPTION OF THE DRAWINGS

Many of the attendant advantages of the present invention will be readily apparent as the invention becomes better understood by reference to the following detailed description with the appended claims, when considered in conjunction with the accompanying drawings, wherein:

FIG. 1 is a side view, partially cut away, of the electromagnetic stirring apparatus according to the present invention.

FIG. 2 is a sectional view of the electromagnetic stirring apparatus according to the present invention taken along line II—II of FIG. 1.

FIG. 3 is a detail of one of the bearings used for a guide roll.

DESCRIPTION OF THE PREFERRED EMBODIMENT

Referring now to the drawings, wherein like reference characters designate like or corresponding parts throughout the several views, FIG. 1 is a partially cut away side view of the electromagnetic stirring device according to the present invention. A continuous casting 1 which is part of a continuous casting installation (not shown) is transported in the direction shown by arrow 2 at a velocity v. Continous casting 1 is, in the example shown, steel which has already solidified on its outer wall and is being transported away from its molten source. Continuous casting 1 is supported at its underside during transport by guide rolls 3 that are tightly spaced with respect to one another. Upper guide rolls 3A (shown only in FIG. 2) guide continuous casting 1 from above.

A stack of ferromagnetic sheets 4 disposed beneath guide rolls 3 and continuous casting 1 includes teeth 5, 6 and 7 lying in planes perpendicular to the plan of transport of the continuous casting and projecting upwards from the ferromagnetic sheets toward the casting, one such tooth between each pair of adjacent guide rolls 3. Teeth 5, 6 and 7 extend close to the surface of continuous casting 1 between guide rolls 3 which are made of non-magnetic material, i.e., non-magnetic steel. Each tooth has a longitudinal extension running in the direction of the rotational axis of guide rolls 3.

Induction coils 5A, 6A and 7A are disposed around teeth 5, 6 and 7 respectively such that teeth 5, 6 and 7 form the core of their respective coils. Coils 5A, 6A and 7A when energized or deenergized produce a changing electro-magnetic field. Coils 5A, 6A and 7A may be electrically coupled to an appropriate power supply in a conventional manner, i.e., in a delta circuit coupled to a three-phase power system. By coupling coils 5A, 6A and 7A through a delta circuit to a three-phase power line, a continuously changing electromagnetic field would be produced within continuous casting 1 by virtue of its proximity to teeth 5, 6 and 7.

Referring now to FIG. 2, which is a sectional view of the electromagnetic stirring apparatus according to the present invention, taken along line II—II of FIG. 1, the rotational axes 3AA of guide rolls 3 together with the stack of ferromagnetic sheets 4 are supported within a bearing frame 8. One of the bearing frames 8 is detailed in FIG. 3, which is a cut away view.

Referring now to FIG. 3, a bearing pin 3B of supporting roll 3 is disposed within roller bearings (not shown) within an abutment 10. Abutment 10 is secured via a flange 12 containing a bore having an insulating insert 13. Layers 14 and 15 provide additional electrical insulation so that no electrical current can flow between bearing pin 3B and bearing frame 8 on which guide rolls 3 are mounted. This insulating feature provides for enhanced electrical safety during operation and is provided on both sides of each guide roll 3.

In order to further reduce the effects of electromagnetically induced currents, upper guide rolls 3A should also be electrically insulated within their respective bearing abutments 10.

By virtue of the continuously changing electromagnetic fields induced by coils 5A, 6A and 7A, particularly with their respective teeth 5, 6 and 7, a stirring effect is achieved within the still liquefied center region of continuous casting 1.

There has therefore been provided an electromagnetic stirring apparatus for use with a continuous casting operation that minimizes leakage fields, thereby forcing more electromagnetic flux through the casting to be stirred. Because the supporting rolls are electrically insulated from one another and from the source of electromagnetic flux, the guide rolls can be fabricated from electrically conductive material without risk of excessive flux loss through the rolls.

Obviously, other embodiments and modifications of the present invention will readily come to those of ordinary skill in the art having the benefit of the teachings presented in the foregoing description and the drawings. It is, therefore, to be understood that this invention is not to be limited thereto and that said modifications and embodiments are intended to be included within the scope of the appended claims.

For example, the inductors could be disposed such that they face one another at both faces of continuous casting 1.

What is claimed and desired to be secured by Letters Patent of the United States is:

1. Electromagnetic stirring apparatus for stirring the solidifying core of a continuous casting comprising:

a roller frame;

at least one pair of guide rolls mounted on said roller frame for transporting said continuous casting, said guide rolls being electrically insulated from said roller frame;

ferromagnetic sheets having at least two teeth positioned in alternating arrangement among said guide rolls each tooth having a longitudinal extension running in the direction of the rotational axis of said guide rolls, wherein adjacent teeth are disposed such that they enclose a guide roll of said continuous casting;

an induction coil surrounding each of said teeth, said teeth and said coils positioned such that passes through said continuous casting to stir the solidifying core of said casting; the path of said flux encircling at least one tooth and closing over a guide roll, current induction in said guide roll being prevented by the electrical insulation of said guide rolls.

2. The electromagnetic stirring apparatus of claim 1 including a stack of ferromagnetic sheets having teeth pointing into the mass of the said continuous casting, said stack being mounted within said roller frame.

3. The electromagnetic stirring apparatus of claim 1 wherein said guide roll is fabricated from nonmagnetic, electrically conductive material.

4. The electromagnetic stirring apparatus of claim 1 including multiple guide rolls that are electrically insulated from one another and from said roller frame.

5. The electromagnetic stirring apparatus of claim 4 further including bearings associated with each such guide roll, said bearings being electrically insulated from said roller frame thereby electrically insulating each of said guide rolls.

* * * * *